US006848884B2

(12) United States Patent
Kawasaki

(10) Patent No.: US 6,848,884 B2
(45) Date of Patent: Feb. 1, 2005

(54) THREE-DIMENSIONAL AXIAL-FLOW TURBINE STAGE

(75) Inventor: Sakae Kawasaki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 12 days.

(21) Appl. No.: 10/203,412

(22) PCT Filed: Feb. 9, 2001

(86) PCT No.: PCT/JP01/00940

§ 371 (c)(1),
(2), (4) Date: Dec. 12, 2002

(87) PCT Pub. No.: WO01/59261

PCT Pub. Date: Aug. 16, 2001

(65) Prior Publication Data

US 2003/0143068 A1 Jul. 31, 2003

(30) Foreign Application Priority Data

Feb. 9, 2000 (JP) ..... 2000-031616

(51) Int. Cl.[7] ..... F01D 1/02

(52) U.S. Cl. ..... 415/199.5; 415/191; 415/211.2; 416/DIG. 5

(58) Field of Search ..... 415/199.5, 193–5, 415/191, 211.2, 192, 208.1–2, 914; 416/DIG. 5, DIG. 2, 243, 223 A

(56) References Cited

U.S. PATENT DOCUMENTS 2,710,136 A * 6/1955 De Ganahl et al. ..... 415/181
6,036,438 A * 3/2000 Imai ..... 415/192

FOREIGN PATENT DOCUMENTS

JP 4-78803 12/1992
JP 05-256103 10/1993
JP 06-081603 3/1994
JP 06-212902 8/1994
JP 2000-018003 1/2000

OTHER PUBLICATIONS

International Search Report of PCT/JP01/00940.

* cited by examiner

*Primary Examiner*—Edward K. Look
*Assistant Examiner*—J. M. McAleenan
(74) *Attorney, Agent, or Firm*—Finnegan, Henderson, Farabow, Garrett & Dunner, L.L.P.

(57) ABSTRACT

An object of the present invention is to reduce the adverse effect of interference between stationary blades and moving blades on the performance of an axial-flow turbine and to provide a high-performance turbine stage. Each of the stationary blades has a trailing edge convex toward a face side with respect to a radial line radially extending from the axis of the rotor shaft, and the each of the moving blades has a blade center-of-gravity line convex toward the face side with respect to a radial line radially extending from the axis of the rotor shaft, and shapes of the stationary blades and the moving blades meet conditions expressed by:

$$1<\theta_{nr}/\theta_{nt}$$

$$1<\theta_{bt}/\theta_{br}$$

where, $\theta_{nt}$ and $\theta_{nr}$ are angles between the stationary blade tip and the stationary blade root, and radial lines, and $\theta_{bt}$ and $\theta_{br}$ are angles between the blade center-of-gravity line of the moving blade at the tip of the same, and the blade center-of-gravity line of the moving blade at the tip of the moving blade, and radial lines.

5 Claims, 13 Drawing Sheets

THREE-DIMENSIONAL AXIAL-FLOW TURBINE STAGE

TECHNICAL FIELD

The present invention relates to an axial-flow turbine and, more particularly, to a turbine stage capable of greatly improving turbine efficiency.

BACKGROUND ART

Insurance of reliability and enhancement of efficiency are important subject relating to axial-flow turbines for power plants from the point of view of environmental problems and saving energy.

Generally, in an axial-flow turbine, such as a steam turbine, a turbine stage is composed of: a plurality of stationary blades 3 fixedly arranged between a nozzle outer ring 1 and a nozzle inner ring 2; and a plurality of moving blades 6 fixedly mounted on a rotor shaft 4 and having tip portions each connected to a shroud 5. One or more turbine stages are axially arranged to form a steam turbine. Recently, a three-dimensional blade has been proposed to improve the efficiency of a turbine through the improvement of the aerodynamic performance of stationary and dynamic blade elements.

The advantage of the conventional three-dimensional blade is achieved by reducing secondary loss produced by a secondary flow in an interblade passage. The secondary flow will be explained with reference to FIG. 8. When a working fluid flows through an interblade passage between adjacent blades 3*a* and 3*b*, inlet boundary layers 8*a* and 8*b*, which are low-energy fluids and are incoming near an endwall 7, impact on the leading edges 9*a* and 9*b* of the blades 3*a* and 3*b*. Consequently, the inlet boundary layers 8*a* and 8*b* are divided into back-side horseshoe vortices 10*a* and 10*b* and face-side horseshoe vortices 11*a* and 11*b*, respectively. The back-side horseshoe vortices 10*a* and 10*b* grow gradually, as boundary layers develop adjacent to the back 12 of the stationary blades 3 and the endwall 7, and flow downstream. Meanwhile, the face-side horseshoe vortices 11*a* and 11*b* are driven by the pressure difference between the face 13 side of the stationary blade 3 and the back 12 side of the stationary blade 3, and grow into passage vortices 14 flowing from the face 13 sides of the stationary blade 3 toward the back 12 sides of the stationary blade 3. The back-side horseshoe vortices 10*a* and 10*b* and the passage vortices 14 are called secondary flow vortices. Thus, the energy of the working fluid is dissipated in generating such secondary flow vortices, resulting in the reduction of turbine performance. Energy thus dissipated by secondary flow vortices will be called secondary flow loss. A large part of the secondary flow loss is caused by the passage vortices 14 that flow downstream across interblade spaces, raising the boundary layer of the low-energy working fluid on the endwall 7. Thus, the suppression of the passage vortices 14 is essential to the reduction of the secondary flow loss.

Prior art three-dimensional blades, as disclosed in JP Hei06-212902A and JP Hei04-78803B, are inclined to the inner and outer endwall 7 surfaces in order to suppress passage vortices. The three-dimensional blades suppress the development of the passage vortices 14 by reducing the pressure difference (Mach number difference) between the blade surfaces, which is the driving force for driving the passage vortices 14, thereby reducing the secondary flow loss and improving performance.

The conventional three-dimensional blades are intended to deal with the secondary flow loss caused between stationary blades 3 and the secondary flow loss caused between moving blades 6, separately, to improve blade performance. However, in order to further improve the total performance of a turbine stage, the three-dimensional shapes of the stationary blade 3 and the moving blade 6 must be designed taking into consideration interference between the stationary blades 3 and the moving blades 6.

Losses that may be produced in a turbine stage will be described with reference to FIGS. 9A and 9B. Losses produced in the turbine stage are classified roughly into:

- a frictional loss caused by friction between the working fluid and the surfaces of stationary blades 3 and moving blades 6 shown in FIG. 9B (hereinafter referred to as "profile loss");
- a secondary flow loss caused by the secondary flow at the endwall 7 portion of the stationary blades 3 and the moving blades 6; and
- a leakage loss caused by a leakage working fluid 16 that leaks from a space between the stationary blades 3 and the moving blades 6 through a gap between fins 15 attached to a stationary member and a shroud 5 without effectively working on the moving blades 6.

The effect, on the performance of the turbine stage, of a blade-element loss (which is the sum of the profile loss and the secondary flow loss) which occurs in the passages between the stationary blades 3 and between the moving blades 6 in a middle stage, will be described with reference to FIG. 10. FIG. 10 is a diagrammatic view showing the expansion of a working fluid in a turbine stage, in which enthalpy h (energy) is measured on the vertical axis, and entropy s is measured on the horizontal axis. In FIG. 10, characters P indicate pressures, points 01, 02, 03, 02rel and 03rel indicate the inlet of the stationary blade 3, the outlet of the stationary blade 3, a total condition of the outlet of the moving blade 6 on a stationary coordinate system, the outlet of the stationary blade, and a total condition of the outlet of the moving blade 6 on a rotating coordinate system, respectively. Points 1, 2 and 3 indicate a stationary state. The output of the turbine stage corresponds to a heat drop A shown in FIG. 10, and the theoretical output of the turbine stage corresponds to a heat drop B. The remainder of subtraction of the heat drop A from the heat drop B is a heat drop loss C. The heat drop loss C is the sum of blade-element heat drop losses caused by the stationary blades 3 and caused by the moving blades 6. The heat drop loss C can be expressed by:

$$C=C_n \times H_n + C_b \times H_b$$

where $H_n$ is a blade-element heat drop loss caused by the stationary blade 3, $H_b$ is a blade-element heat drop loss caused by the moving blade 6, $C_n$ and $C_b$ are coefficients representing the degrees of effect of the stationary blade 3 and the moving blade 6 on blade-element loss, respectively (hereinafter referred to as "influence coefficients"). The influence coefficients $C_n$ and $C_b$ are functions of the ratio D/A, where D is a heat drop caused by the moving blades 6, and A is a heat drop caused by the stationary blades 3 and the moving blades 6. The ratio D/A will be called a reaction degree. The greater the reaction degree, i.e., the greater the heat drop caused by the moving blades 6, the greater is the influence coefficient $C_b$ of the moving blades 6 and the smaller is the influence coefficient $C_n$ of the stationary blades 3. On the contrary, the smaller the reaction degree, i.e., the smaller the heat drop caused by the moving blades 6, the smaller is the influence coefficient $C_b$ of the moving blades 6 and the greater is the influence coefficient $C_n$ of the stationary blades 3. FIGS. 11A and 11B are graphs showing the variation of the stationary blade influence coefficient $C_n$ with the height of a stationary blade 3 and the variation of the moving blade influence coefficient $C_b$ with the height of a moving blade 6, respectively, in a general axial turbine stage. Since a reaction degree at a lower height is smaller in the distribution of the reaction degree, and a reaction degree at a higher height is greater. Therefore, the influence coefficient for the tip of the moving blade 6 is greater than that for the root of the moving blade 6 as shown in FIG. 11B, and hence it is effective to reduce the blade-element loss at the tip of the moving blade 6 for the reduction of the loss in the turbine stage. The influence coefficient for the root of the stationary blade 3 is greater than that for the tip of the stationary blade 3 as shown in FIG. 11A, and hence it is effective to reduce the blade-element loss at the root of the stationary blade 3 for the reduction of the loss in the turbine stage.

The advantage of a prior art three-dimensional moving blade 6 disclosed in JP Hei 06-22902A is shown in FIG. 12, in which stage efficiency ratio $n_i/n_o$, where $n_i$ is the stage efficiency of a turbine state employing inclined three-dimensional blades 6 and $n_o$ is the stage efficiency of a turbine stage employing not-inclined moving blades 6, is measured on the vertical axis, and the tip inclination $\theta_{bt}$, i.e., the inclination at the tip of the moving blade 6, and the root inclination $\theta_{br}$, i.e., the inclination at the root of the moving blade 6, are measured on the horizontal axis. (The inclination is represented by the inclination of the blade center-of-gravity line toward the face of the blade with respect to a radial line extending from the axis of a rotor shaft and intersecting the blade center-of-gravity line.) As obvious from FIG. 12, the improvement of the stage efficiency can be achieved when the tip inclination $\theta_{bt}$ and the root inclination $\theta_{br}$ are equal and are in a predetermined range of 2° to 22°; that is, the pressure difference between the back side and the face sides of the blade varies in proportion to the blade inclination, and the greater the inclination, the smaller the pressure difference and the smaller the secondary flow loss. When the inclination increases beyond a limit angle, the flow of the working fluid along a middle part of the blade decreases, the flow of the same along the end wall 7 increases and, consequently, the performance of the stage is deteriorated. With respect to the above, the inclination of the conventional blade is determined within the predetermined angular range.

However, as mentioned above, it is effective to reduce the blade-element loss at the tip of the moving blade 6 for the reduction of the loss in the turbine stage. Therefore, a turbine stage having different inclinations $\theta_{bt}$ and $\theta_{br}$ operates at a higher efficiency. JP Hei04-78803B discloses that the stage efficiency of a turbine stage is improved by determining inclination of stationary blades 3 in the range of 2.5° to 25°. However, it is possible that the efficiency of the turbine stage can be further improved by using stationary blades 3 having, similarly to the moving blade 6, a tip inclination $\theta_{nt}$ and a root inclination $\theta_{nr}$ different from the tip inclination $\theta_{nt}$. A high-efficiency turbine stage can be formed by using, in combination, stationary blades 3 and moving blades 6 respectively having proper tip inclinations and root inclinations.

Since the roots of the stationary blade 3 and the moving blade 6 of a turbine stage, and the tips of the same have different reaction degrees, respectively, fluid pressure changes with the height of the blades, and conditions for the occurrence of loss changes. Therefore, the respective three-dimensional shapes of the stationary blade 3 and the moving blade 6 have effect on each other. In FIG. 13, continuous lines indicate inlet and outlet pressure distributions with respect to height of a stationary blade 3 and a moving blade 6 of a general axial flow turbine stage. In FIG. 13, blade height is measured on the vertical axis and pressure is measured on the horizontal axis. It is known from FIG. 13 that inlet pressure is constant with respect to blade height at the inlet of the stationary blade 3, outlet pressure at the outlet of the stationary blade 3 (inlet pressure at the inlet of the moving blade 6) increases with the increase of the height, and outlet pressure at the outlet of the moving blade 6 remains substantially constant regardless of height. Thus, the pressure difference between the inlet and outlet is small at the root of the moving blade 6 and is large at the tip of the moving blade 6. In FIG. 13, broken lines indicate inlet and outlet pressure distributions with respect to height of an inclined three-dimensional stationary blade 3 and an inclined three-dimensional moving blade 6. Stationary blade outlet pressure and moving blade outlet pressure at the tip and at the root in a turbine stage provided with the three-dimensional blades are higher than those in a general turbine stage, which is because the inclination of the blades reduces the pressure difference between the surfaces of the blade and raises the outlet pressure. FIG. 14 is a graph showing the dependence of pressure rise on the inclination.

As obvious from FIG. 14, pressure increment increases with the increase of the inclination. The rise of stationary blade outlet pressure and moving blade outlet pressure at the root of the blade affects the blade element performance. The relation between blade inclination at the root of the moving blade 6 and blade element loss will be described in connection with FIG. 15, in which moving blade root blade element loss is measured on the vertical axis, and inclination $\theta_{br}$ is measured on the horizontal axis. As shown in FIG. 15, the inclination $\theta_{br}$ is an angle of the blade center-of-gravity line of the moving blade 6 toward the face-side of the moving blade 6 with respect to a radial line extending from the axis of a rotor shaft 4. As obvious from FIG. 15, the pressure difference between the moving blades 6 decreases with the increase of the inclination $\theta_{br}$, and thus secondary flow loss decreases and blade element loss decreases. However, since the pressure difference between the inlet and the outlet of the root area of the moving blades 6 is small, the outlet pressure exceeds the inlet pressure when the root inclination $\theta_{br}$ increases beyond a certain angle, the working fluid decelerates as the same is flowing along the blade, the working fluid separates from the blade and, consequently, blade-element loss increases. Thus, the moving blade 6 has an optimum root inclination that minimizes blade-element loss. When a three-dimensional stationary blade 3 is employed, stationary blade outlet pressure (moving blade inlet pressure) increases. Therefore, the optimum root inclination of the moving blade 6, which minimizes the blade-element loss occurred at the root area of the moving blade 6, thus changes. In FIG. 15, a point a indicates an optimum moving blade root inclination when the three-dimensional moving blades 6 are used in combination with conventional stationary blades 3 having a stator blade root inclination $\theta_{nr}$=0° (continuous line). A point b indicates an optimum moving blade root inclination when the three-dimensional moving blades 6 are used in combination with three-dimensional stationary blades 3 (broken line). It is known, from the comparison of the optimum three-dimensional moving blade root inclination a when the three-dimensional moving blades 6 are used in combination with conventional stationary blades 3, and the optimum three-dimensional moving blade root inclination b when the three-dimensional moving blades 6 are used in combination with three-dimensional stationary blades 3, that the moving blade inclination at which the separation of the working fluid occurs increases because the stationary blade output pressure increases, and hence the moving blade root inclination can be increased. Increase of moving blade inclination causes further reduction of secondary flow loss. Since the optimum moving blade root inclination b when the moving blade 6 is used in combination with the three-dimensional stationary blade 3 is dependent on the three-dimensional stationary blade root inclination $\theta_{nr}$, there is a correlation between stationary blade root inclination and moving blade root inclination to minimize blade-element loss.

Leakage loss is caused by a leakage working fluid that leaks from a space between the stationary blade 3 and the moving blade 6 through a gap between fins 15 attached to a stationary member and a shroud 5, does not act on the moving blade 6 and does not perform effective work. The greater the pressure difference at the outlet of the stationary blade 3 and at the outlet of the moving blade 6, the greater is the leakage flow and, hence the greater is leakage loss. In a turbine stage provided with three-dimensional stationary blades and three-dimensional moving blades, pressure at the outlet of the stationary blade and pressure at the outlet of the moving blade are higher than those in a conventional turbine stage as shown in FIG. 13 owing to the respective shapes of the stationary and the moving blade. Since pressure increment is dependent on stationary blade tip inclination and moving blade tip inclination, the pressure differences at the stationary blade outlet and the moving blade outlet increase. Consequently, leakage loss increases and the efficiency of the turbine stage decreases. For example, when the moving blade tip inclination $\theta_{bt}$ is greater than the stationary blade tip inclination $\theta_{nt}$, a pressure increment associated with the stationary blade tip inclination is greater than a pressure increment associated with the moving blade tip inclination, the pressure difference at the tip of the moving blade increases and, consequently, leakage loss increases.

Thus, the three-dimensional shape (inclination) of the stationary blade 3 and that of the moving blade 6 are correlated in the turbine stage, and the improvement of the performance of the turbine stage cannot satisfactorily achieved only through the individual reduction of the secondary flow losses caused by the stationary blade 3 and the moving blade 6.

SUMMARY OF THE INVENTION

The present invention has been made in view of such circumstances and it is therefore an object of the present invention to reduce the adverse effect of interference between stationary blades and moving blades on the performance of a turbine stage and to provide a high-performance turbine stage.

The present invention provides an axial-flow turbine stage including: a plurality of moving blades fixedly mounted on a rotor shaft in a circumferential arrangement about the axis of the rotor shaft; and a plurality of stationary blades disposed axially opposite to the moving blades in a circumferential arrangement about the axis of the rotor shaft; wherein each of the plurality of stationary blades has a trailing edge convex toward the face side with respect to a radial line radially extending from the axis of the rotor shaft, and the blade center-of-gravity line of each of the plurality of moving blades is convex toward the face side with respect to a radial line radially extending from the axis of the rotor shaft.

In the axial-flow turbine of the present invention, the shapes of the stationary blades and the moving blades meet conditions expressed by:

$$1<\theta_{nr}/\theta_{nt}$$

$$1<\theta_{bt}/\theta_{br}$$

where, as viewed from a direction parallel to the axis of the rotor shaft, $\theta_{nr}$ is an angle between a tangent to the trailing edge of the stationary blade at the tip of the same and a radial line passing the tip of the stationary blade and radially extending from the axis of the rotor shaft, $\theta_{nr}$ is an angle between a tangent to the trailing edge of the stationary blade at the root of the same and a radial line passing the root of the stationary blade and radially extending from the axis of the rotor shaft, $\theta_{bt}$ is an angle between a tangent to the blade center-of-gravity line of the moving blade at the tip of the same and a radial line passing the tip of the moving blade and radially extending from the axis of the rotor shaft, $\theta_{br}$ is an angle between a tangent to the blade center-of-gravity line of the moving blade at the root of the same and a radial line passing the root of the moving blade and radially extending from the axis of the rotor shaft.

Alternatively, the angles $\theta_{nr}$, $\theta_{nt}$, $\theta_{bt}$ and $\theta_{br}$ may meet a condition expressed by:

$$1<\theta_{nr}/\theta_{br}<3$$

Alternatively, the angles $\theta_{nr}$, $\theta_{nr}$, $\theta_{bt}$ and $\theta_{br}$ may meet a condition expressed by:

$$0.3<\theta_{nt}/\theta_{bt}<1$$

Alternatively, the angles $\theta_{nr}$, $\theta_{nt}$, $\theta_{bt}$ and $\theta_{br}$ may meet conditions expressed by:

$$1<\theta_{nr}/\theta_{br}<3$$

$$0.3<\theta_{nt}/\theta_{bt}<1$$

DESCRIPTION OF THE PREFERRED EMBODIMENTS

Figure 1A:
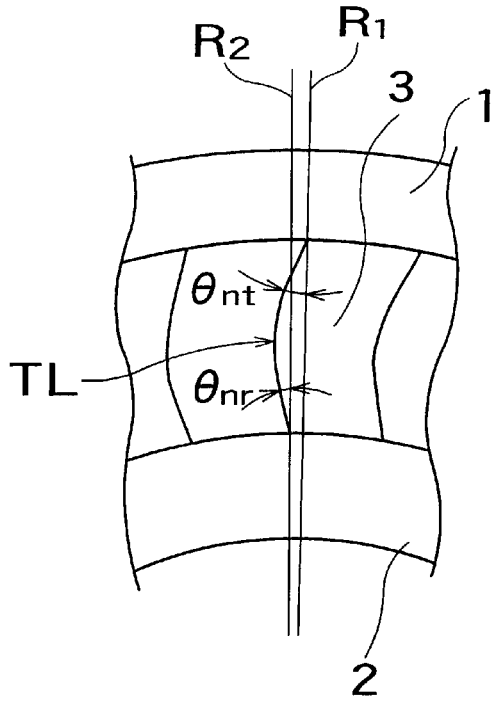
FIG. 1A is a schematic view, taken in an axial direction, of a stationary blade of a three-dimensional axial-flow turbine stage according to the present invention.
Figure 1B:
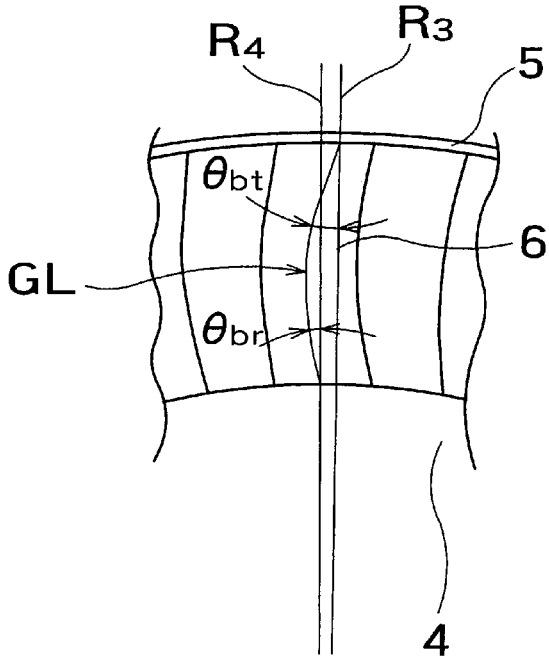
FIG. 1B is a schematic view, taken in an axial direction, of a moving blade of the three-dimensional axial-flow turbine stage according to the present invention.

An axial-flow turbine stage embodying the present invention will be described with reference to the accompanying drawings. FIGS. 1A and 1B show an axial-flow turbine stage in a first embodiment according to the present invention. FIG. 1A is a view of a stationary blade 3 taken in the axial direction from the outlet side, and FIG. 1B is a view of a moving blade 6 taken in the axial direction from the outlet side.

A plurality of stationary blades 3 are arranged in a circumferential arrangement abut the axis, not shown, of a rotor shaft 4 shown in FIG. 1B. The stationary blades 3 are fixed to an outer ring 1 and an inner ring 2. As shown in FIG. 1A, each stationary blade 3 has a trailing edge TL convex toward a face side with respect to radial lines $R_1$ and $R_2$ radially extending from the axis of the rotor shaft 4

Figure 2:
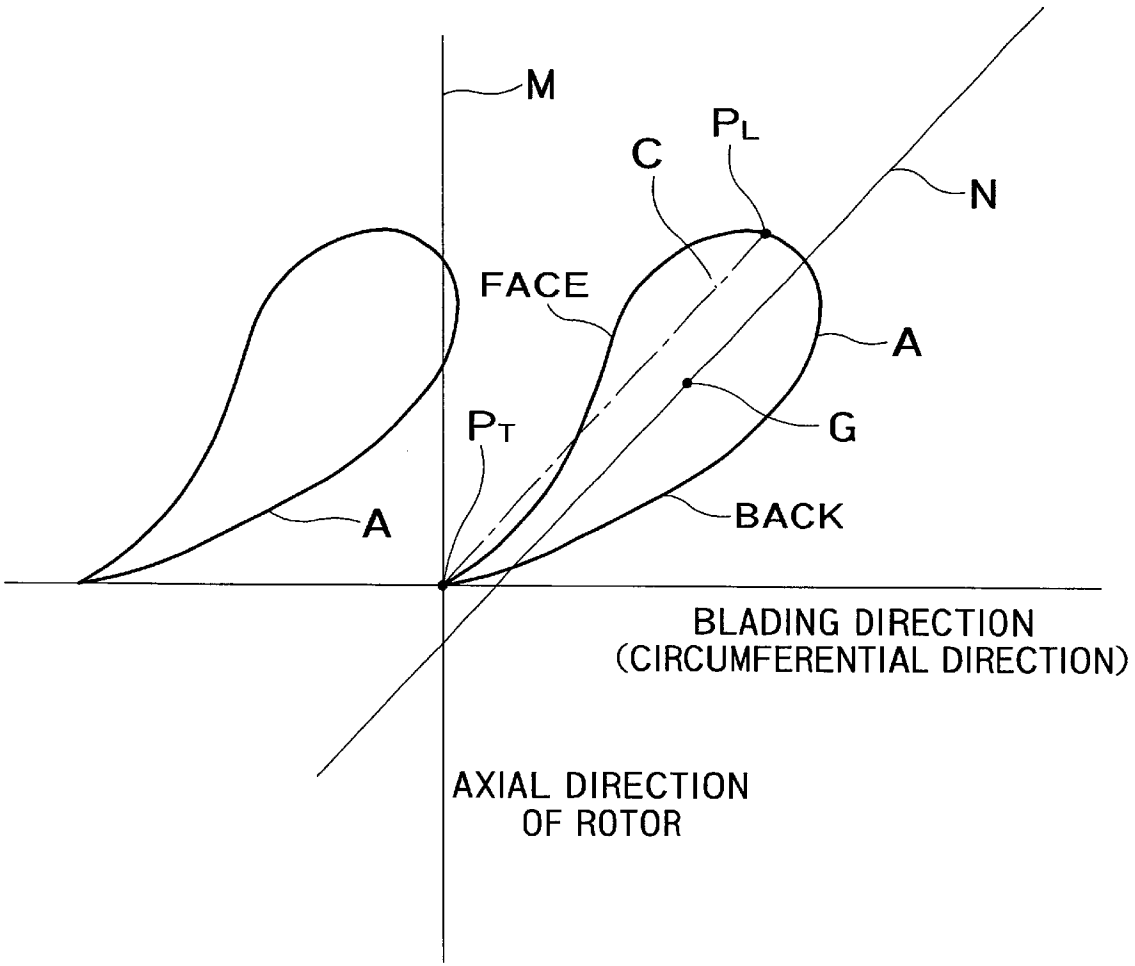
FIG. 2 is a diagrammatic view of assistance in explaining the definition of a term "face side" used in this invention.

In this specification, the expression "the trailing edge TL of the stationary blade is convex toward a face side with respect to radial lines" signifies a state where the shape of the trailing edge of the stationary blade meets the following condition. Suppose the tip of the stationary blade 3 has a blade profile A as shown in FIG. 2. Then, a plane M, which is represented by a straight line in FIG. 2, including a radial line (the radial line $R_1$ in FIG. 1A) passing a point $P_T$ on the trailing edge of the tip of the stationary blade and parallel to the axis of the rotor shaft 4 can be defined. Suppose the root of the stationary blade 3 has a blade profile A as shown in FIG. 2. Then, a plane M, which is represented by a straight line in FIG. 2, including a radial line (the radial line $R_2$ in FIG. 1A) passing a point $P_T$ on the root and the trailing edge of the stationary blade and parallel to the axis of the rotor shaft 4 can be defined. Then, "the trailing edge of the stationary blade is convex toward the face side with respect to the radial line" signifies that:

(i) The entire trailing edge of a part of the stationary blade between the tip and the root (hereinafter referred to as "stationary blade middle part") is off to the left, as viewed in FIG. 2, from the plane M defined at one of the stationary blade tip and the stationary blade root (defined at the stationary blade tip or the stationary blade root).

(ii) At least a part of the trailing edge of the stationary blade middle part on the side of the other of the stationary blade tip and the stationary blade root (on the side of the stationary blade root or the stationary blade tip) is off to the left, as viewed in FIG. 2, from the planes M defined at said the other of the stationary blade tip and the stationary blade root (defined at the stationary blade root or the stationary blade tip).

(iii) A remotest point at the longest distance from the plane M (which may be either the plane M defined at the tip or the plane M at the root) lies on the trailing edge. In addition, a distance between the plane M and a point lying on the trailing edge increases, as said point lying on the trailing edge comes closer to the remotest point from the tip and the root.

The moving blade 6 will be described. The plurality of moving blades 6 are fixedly mounted on the rotor shaft 4 in a circumferential arrangement about the axis of the rotor shaft 4, and the tips of the moving blades are connected to a shroud 5. As shown in FIG. 1B, each moving blade 6 has a center-of-gravity line GL convex toward the face side with respect to radial lines $R_3$ and $R_4$ radially extending from the axis of the rotor shaft 4.

In this specification, "the center-of-gravity line" is a line obtained by sequentially connecting the geometric centroids of blade profiles (hereinafter referred to as "blade-centroids") at different levels of the moving blade 6.

In this specification, "the center-of-gravity line of the moving blade is convex toward the face side with respect to the radial line" signifies that the center-of-gravity line of the moving blade has a shape meeting the following conditions.

Suppose that the tip of the moving blade has the blade profile A as shown in FIG. 2. Then, a plane N, which is represented by a straight line in FIG. 2, including: a straight line parallel to the cord C connecting a point $P_T$ indicating the trailing edge of the tip of the moving blade and a point $P_L$ indicating the leading edge of the tip of the moving blade and passing a blade-centroid G; and a radial line passing the blade-centroid G (a radial line $R_3$ in FIG. 1B) can be defined. Suppose that the root of the moving blade has the blade profile A as shown in FIG. 2. Then, a plane N, which is represented by a straight line in FIG. 2, including: a straight line parallel to the cord C connecting a point $P_T$ indicating the trailing edge of the root of the moving blade and a point PL indicating the leading edge of the root of the moving blade and passing a blade centroid G; and a radial line passing the blade centroid G (a radial line $R_4$ in FIG. 1B) can be defined. The expression "the center-of-gravity line of the moving blade is convex toward the face side with respect to the radial line" signifies that:

(i) The entire part of the blade center-of-gravity line in a part of the moving blade between the moving blade tip and the moving blade root (hereinafter referred to as "moving blade middle part") is off toward an upper left-hand side, as viewed in FIG. 2, from the plane N defined at one of the moving blade tip or the moving blade root (defined at the moving blade tip or the moving blade root).

(ii) At least a part of the blade center-of-gravity line of the moving blade middle part on the side of the other of the moving blade tip and the moving blade root is off toward the upper left-hand side, as viewed in FIG. 2, from the plane N defined at the other of the moving blade tip and the moving blade root (defined at the moving blade root or the moving blade tip).

(iii) A remotest point at the longest distance from the plane N, which may be either the plane N at the moving blade tip or the plane N at the moving blade root, lies on the blade center-of-gravity line. In addition, a distance between the plane N and a point lying on the blade center-of-gravity line increases, as said point lying on the center-of-gravity line comes closer to the remotest point.

Referring again to FIGS. 1A and 1B, the shapes of the stationary blades 3 and the moving blades 6 are formed in shapes meeting conditions expressed by:

$$1<\theta_{nr}/\theta_{nt}$$

$$1<\theta_{bt}/\theta_{br}$$

where, as viewed from a direction parallel to the axis of the rotor shaft 4, $\theta_{nt}$ is an angle between a tangent to the trailing edge TL of the stationary blade 3 at the tip of the same and a radial line $R_1$ passing the tip of the stationary blade 3 and radially extending from the axis of the rotor shaft 4 (hereinafter referred to as "stationary blade tip inclination"), $\theta_{nr}$ is an angle between a tangent to the trailing edge TL of the stationary blade 3 at the root of the same and a radial line $R_2$ passing the root of the stationary blade 3 and radially extending from the axis of the rotor shaft 4 (hereinafter referred to as "stationary blade root inclination") $\theta_{bt}$ is an angle between a tangent to the blade center-of-gravity line GL of the moving blade 6 at the tip of the same and a radial line $R_3$ passing the tip of the moving blade 6 and radially extending from the axis of the rotor shaft 4 (hereinafter referred to as "moving blade tip inclination"), and $\theta_{br}$ is an angle between a tangent to the blade center-of-gravity line GL of the moving blade 6 at the root of the same and a radial line $R_4$ passing the root of the moving blade 6 and radially extending from the axis of the rotor shaft 4 (hereinafter referred to as "moving blade root inclination").

Although the stationary blade 3 is formed such that the radial lines $R_1$ and $R_2$ are not aligned as shown in FIG. 1A when the stationary blade 3 is viewed from a direction parallel to the axis of the rotor shaft 4, the stationary blade 3 may be formed such that the radial lines $R_1$ and $R_2$ are aligned. Although the moving blade 6 is formed such that the radial lines $R_3$ and $R_4$ are not aligned as shown in FIG. 1B when the moving blade 6 is viewed from a direction parallel to the axis of the rotor shaft 4, the moving blade 6 may be formed such that the radial lines $R_3$ and $R_4$ are aligned. Although the stationary blade 3 and the moving blade 3 are formed such that the radial lines $R_1$ and $R_2$ are not aligned and the radial lines $R_3$ and $R_4$ are not aligned as shown in FIGS. 1A and 1B for the clear description of the present invention, it is preferable to form the stationary blade 3 and the moving blade 6 such that the radial lines $R_1$ and $R_2$ are aligned and the radial lines $R_3$ and $R_4$ are aligned to facilitate manufacturing the axial-flow turbine stage. Either case has the effect of the present invention in improving performance.

Figure 3:
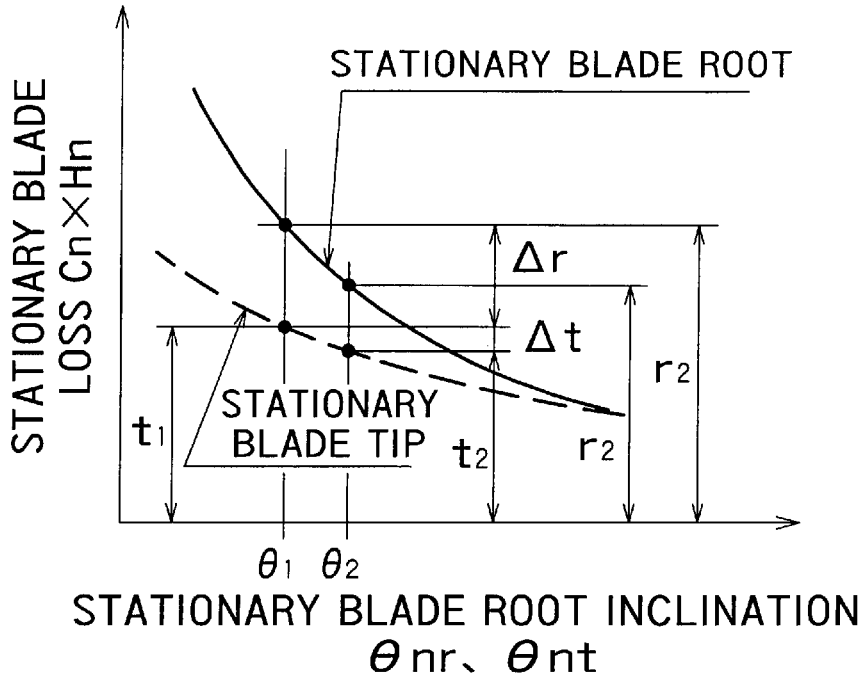
FIG. 3 is a graph of assistance in explaining the operation of a three-dimensional axial-flow turbine state in a first embodiment according to the present invention.
Figure 13:
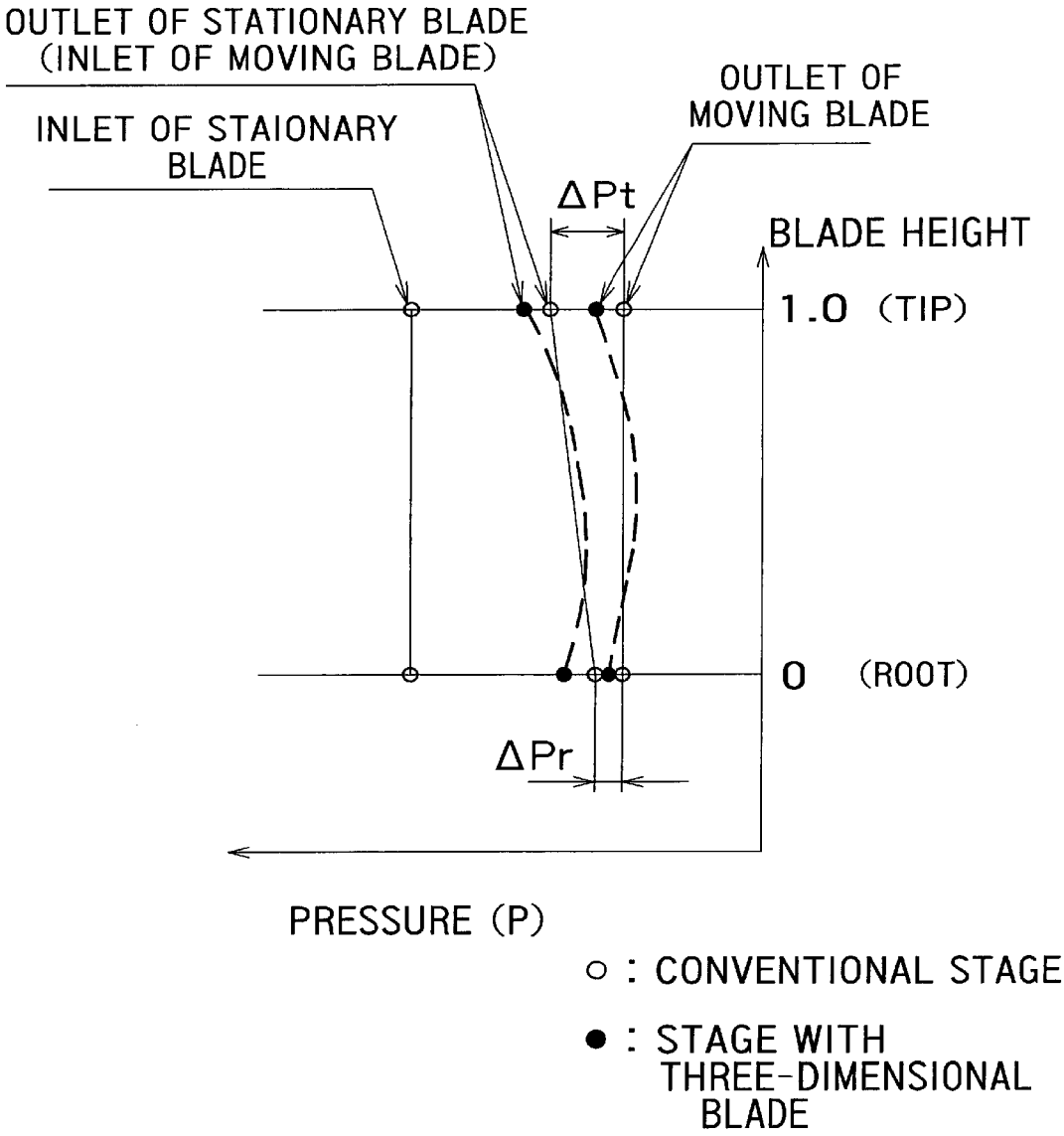
FIG. 13 is a diagram showing pressure distributions in the axial-flow turbine stage.
Figure 14:
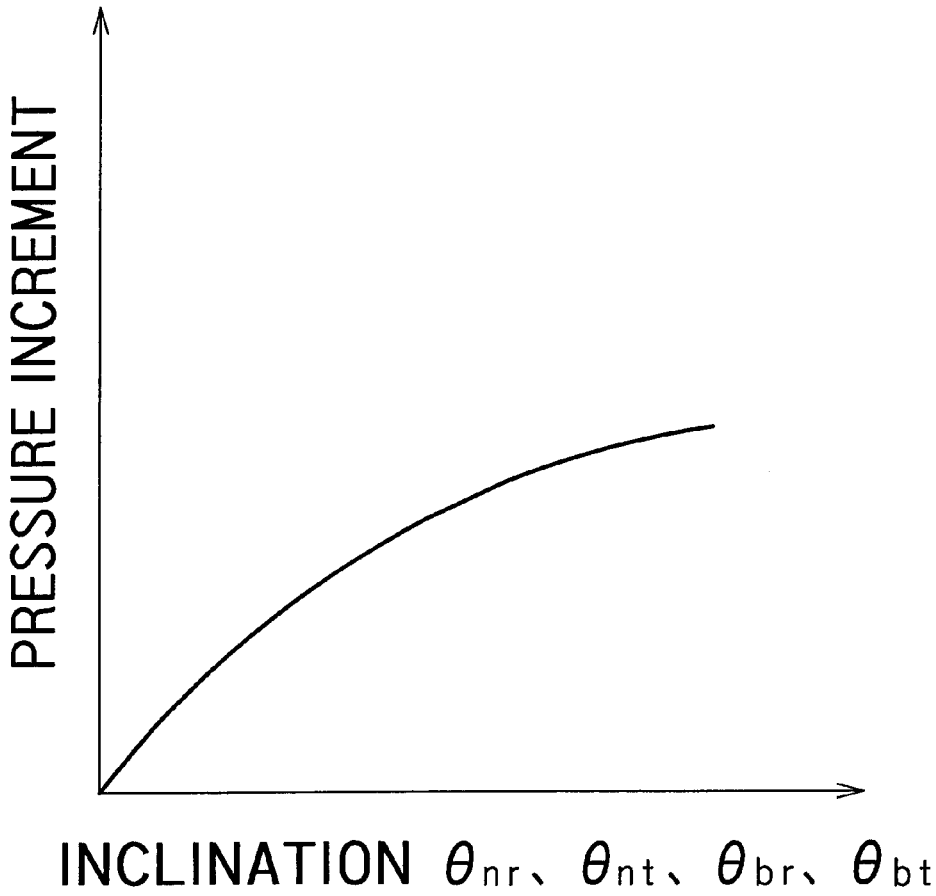
FIG. 14 is a graph showing the relation between inclination and pressure increment.
Figure 15A:
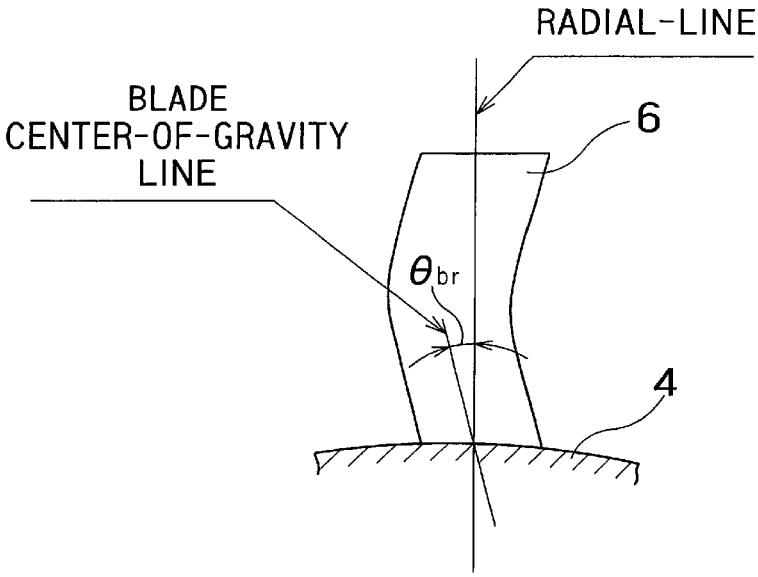
FIG. 15A is a schematic view of assistance in explaining an inclination.
Figure 15B:
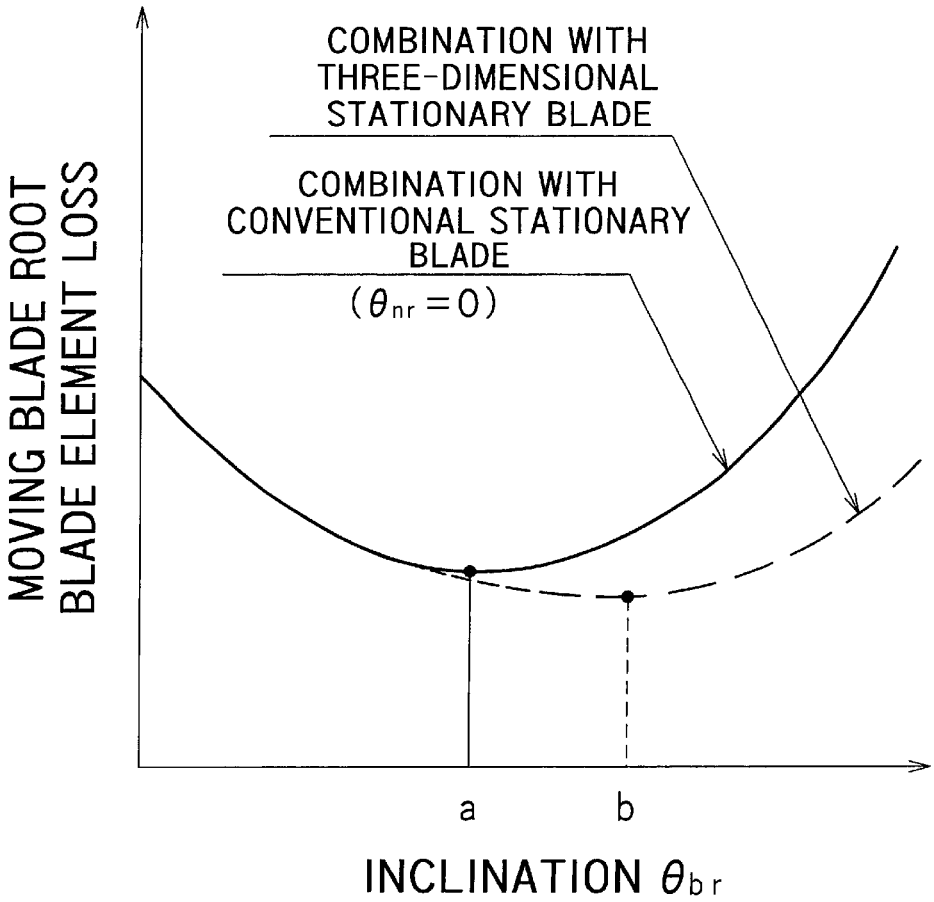
FIG. 15B is a graph showing the relation between moving blade root blade element loss and inclination.

FIG. 3 shows the relation between the inclination of the stationary blade, and stationary blade loss, which is a product of blade-element heat drop loss $H_n$ caused by the stationary blade 3 and the influence coefficient $C_n$, of the stationary blade 3. In FIG. 3, a continuous line indicates the variation of stationary blade loss caused at the stationary blade root, and a broken line indicates the variation of stationary blade loss caused by the stationary blade tip. The stationary blade loss ($H_n \times C_n$) caused by the stationary blade tip is smaller than the stationary blade loss caused by the root of the stationary blade 3 because the degree of reaction of the tip is large and the influence coefficient is small as shown in FIG. 13. Total loss ($r_1+t_1$) when both the stationary blade tip inclination $\theta_{nt}$ and the stationary blade root inclination $\theta_{nr}$ are equal to $\theta_1$ is greater than total loss ($r_1+t_2$) when the stationary root inclination $\theta_{nr}=\theta_1$ and the stationary tip inclination $\theta_{nt}=\theta_2((r_1+t_1)>(r_1+t_2))$. Thus, when the stationary blade tip inclination $\theta_{nt}$ is greater than the stationary blade root inclination $\theta_{nr}$, total loss is smaller than that when $\theta_{nr}=\theta_{nt}$, and the performance of the turbine stage is improved.

Total loss ($r_1+t_1$) when both the stationary blade tip inclination $\theta_{nr}$ and the stationary blade root inclination $\theta_{nr}$ are equal to $\theta_1$ is greater than total loss ($r_2+t_1$) when the stationary root inclination $\theta_{nr}=\theta_2$ and the stationary tip inclination $\theta_{nt}=\theta_1$ $((r_1+t_1)>(r_2+t_1))$. Thus, when the stationary blade tip inclination $\theta_{nt}$ is smaller than the stationary blade root inclination $\theta_{nr}$, total loss is smaller than that when $\theta_{nr}=\theta_{nt}$. However, since the rate of change of static pressure loss with the change of the stationary blade root inclination is high ($\Delta r>\Delta t$), it is obviously more effective in improving the performance of the turbine stage to form the stationary blade 3 such that $\theta_{nt}<\theta_{nr}$. The rate of change of static pressure loss with the change of the stationary blade root inclination being high. This is because, the degree of reaction at the root of the stationary blade 3 is lower than that at the tip of the stationary blade 3, the pressure difference between the inlet and outlet of the stationary blade 3 is large, the secondary flow loss is large, and hence the secondary flow loss changes at a high rate when the inclination changes. Thus, the performance of the turbine stage can be improved when $1<\theta_{nr}/\theta_{nt}$.

Figure 4:
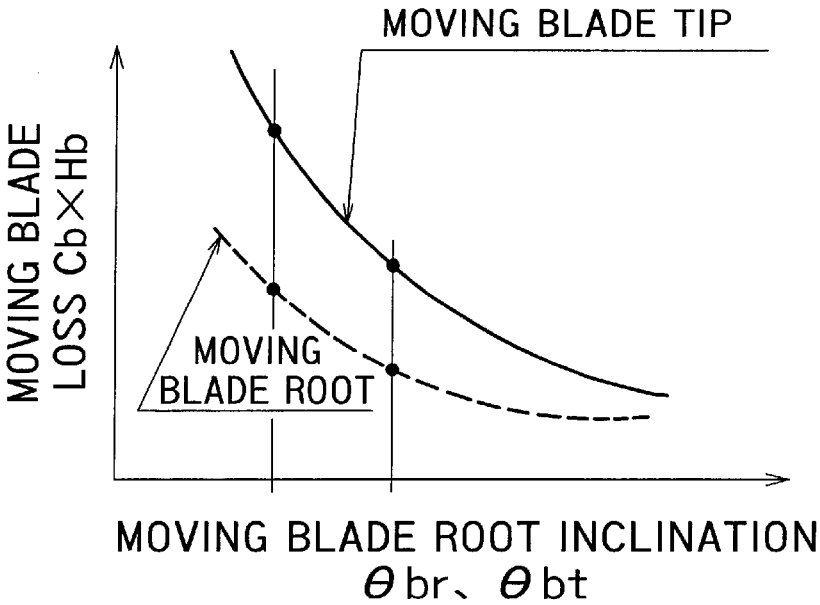
FIG. 4 is a graph of assistance in explaining the operation of a three-dimensional axial-flow turbine state in the first embodiment.

FIG. 4 shows the relation between the inclination of the moving blade, and moving blade loss, which is a product of blade element loss enthalpy drop $H_b$ caused by the moving blade 6 and the influence coefficient $C_b$ of the moving blade 6. In FIG. 4, a continuous line indicates the variation of moving blade loss caused at the moving blade root, and a broken line indicates the variation of moving blade loss caused by the moving blade tip. The moving blade loss ($H_b \times C_b$) caused by the moving blade tip is greater than the moving blade loss caused by the root of the moving blade 6. This is because, the degree of reaction of the tip is larger than that of the root and the influence coefficient is large as shown in FIG. 13. The functional characteristic of the moving blade 6 is reverse to that of the stationary blade 3 shown in FIG. 3, and it is effective in improving the performance of the turbine stage to form the moving blade 6 such that $\theta_{br}<\theta_{bt}$.

Figure 5:
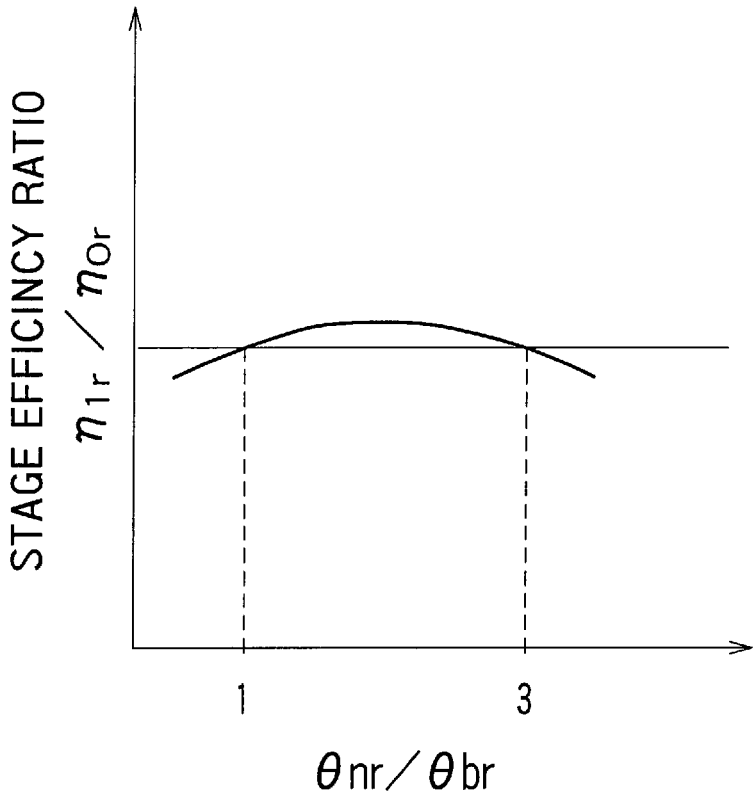
FIG. 5 is a graph showing the dependence of stage efficiency ratio on $\theta_{nr}/\theta_{br}$ in the three-dimensional axial-flow turbine stage according to the present invention.

FIG. 5 is a graph showing the variation of stage efficiency of the three-dimensional axial-flow turbine. In the graph, the ratio $\theta_{nr}/\theta_{br}$ is measured on the horizontal axis; and stage efficiency ratio $\eta_{1r}/\eta_{0r}$, where $\eta_{0r}$ is stage efficiency when $\theta_{nr}=\theta_{br}$, and $\eta_{1r}$ is stage efficiency when the ratio $\theta_{nr}/\theta_{br}$ is changed, is measured on the vertical axis. As obvious from FIG. 5, stage efficiency $\eta_{1r}$ is higher than stage efficiency $\eta_{0r}$ in a range expressed by $1<\theta_{nr}/\theta_{br}<3$, which is because the pressure difference between the inlet and the outlet of the moving blade 6 when $\theta_{nr}<\theta_{br}$ is smaller than that when $\theta_{nr}=\theta_{br}$, separation is induced on the moving blade 6 to increase moving blade loss and, consequently, stage efficiency is reduced. If the moving blade root inclination $\theta_{nr}$ is excessively small, the secondary flow loss reducing effect of the three-dimensional moving blade 6 is reduced.

Therefore, stage efficiency can be improved when $1<\theta_{nr}/\theta_{br}<3$.

Figure 6:
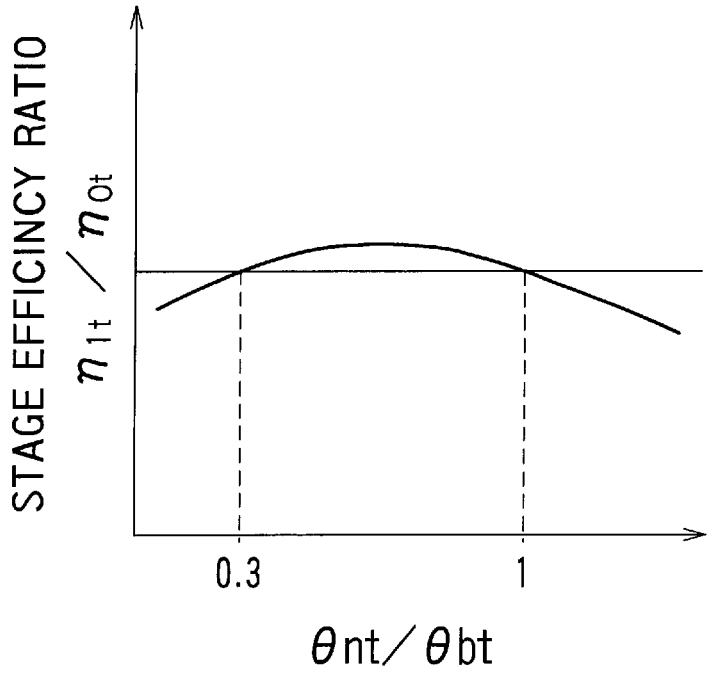
FIG. 6 is a graph showing the dependence of stage efficiency ratio on $\theta_{nt}/\theta_{bt}$ in the three-dimensional axial-flow turbine stage according to the present invention.
Figure 7:
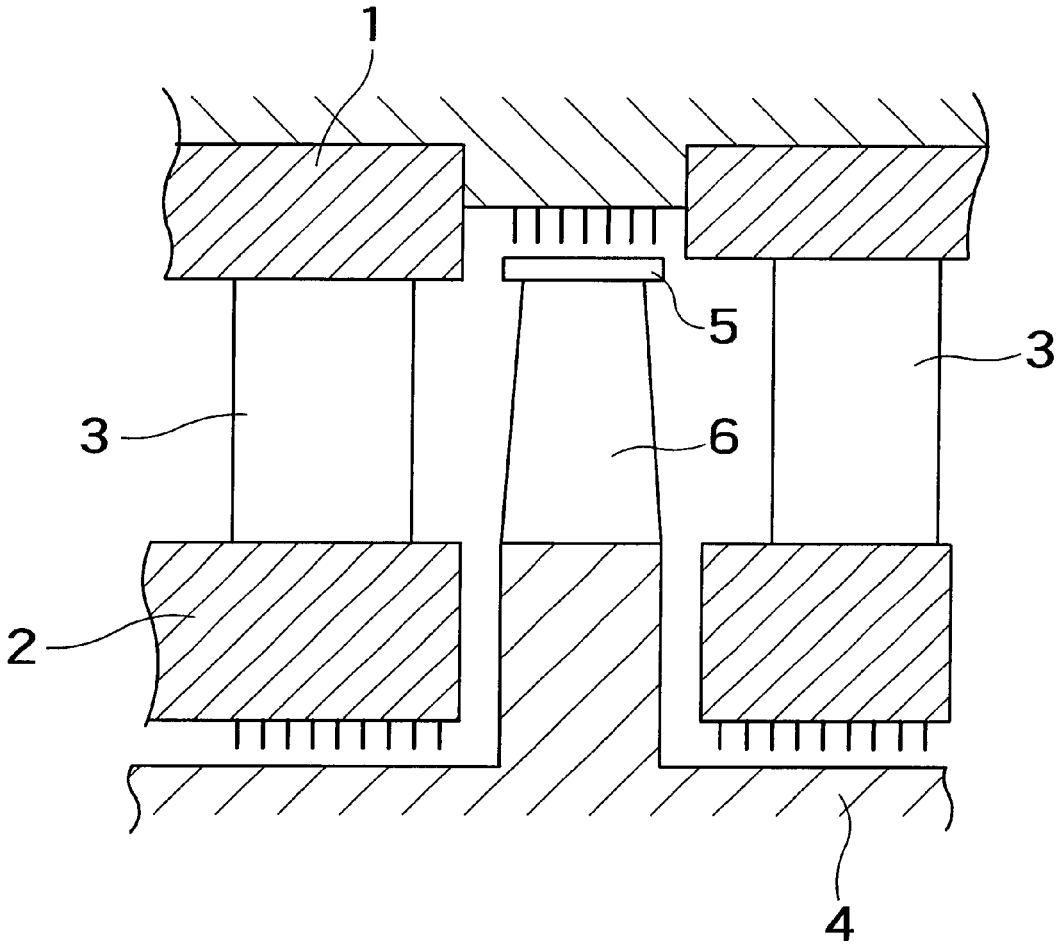
FIG. 7 is a schematic view of an axial-flow turbine stage.
Figure 8:
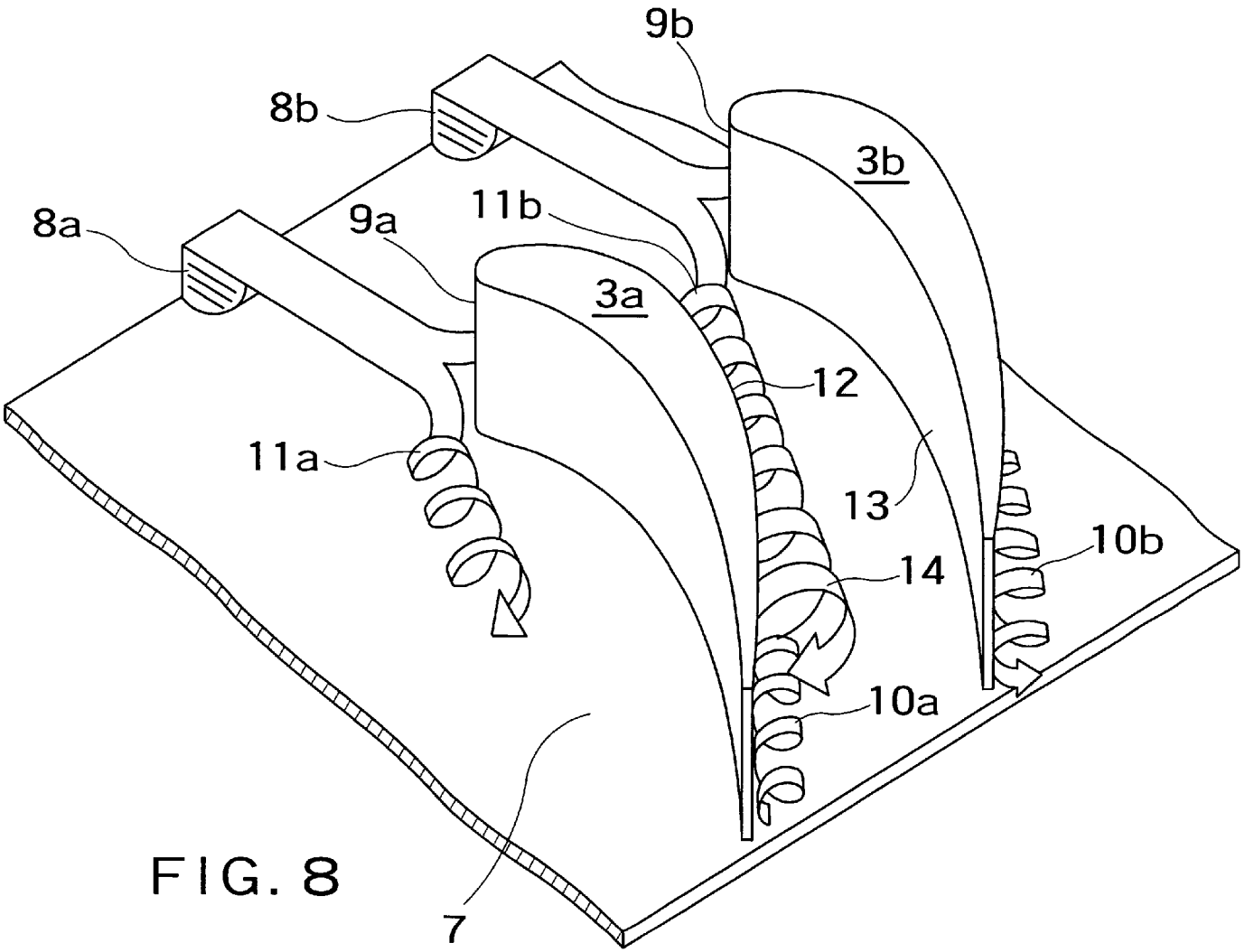
FIG. 8 is a perspective view of assistance in explaining secondary flows.
Figure 9A:
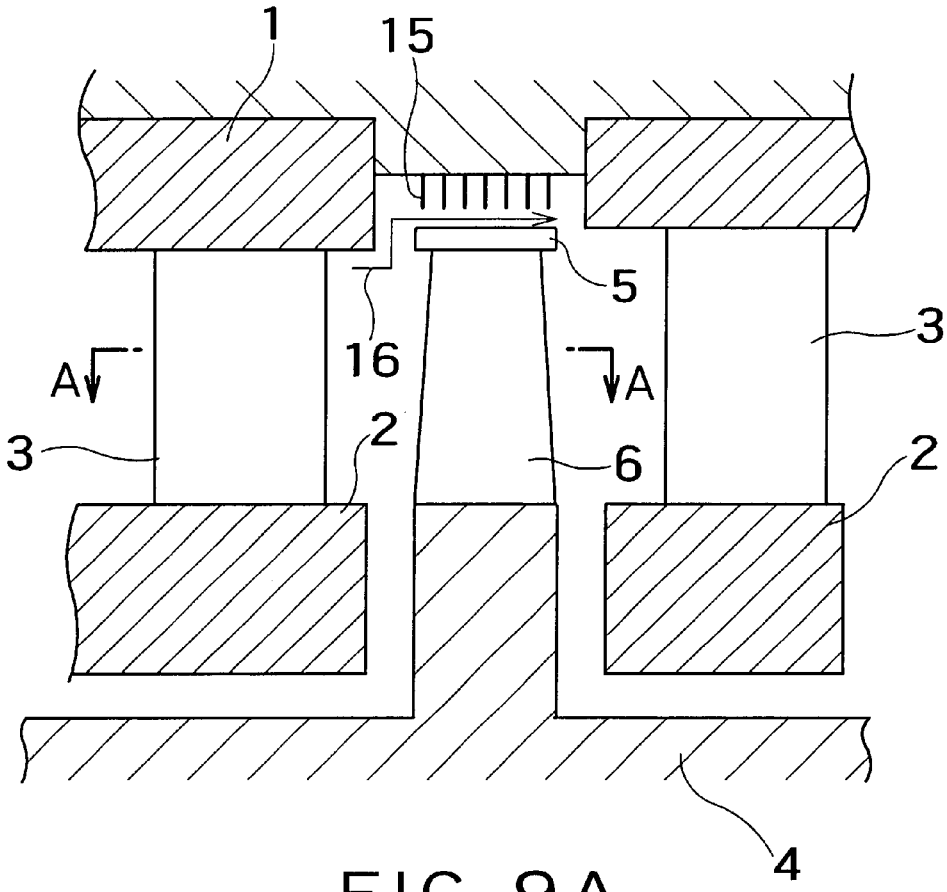
FIG. 9A is a schematic view of an axial-flow turbine stage.
Figure 9B:
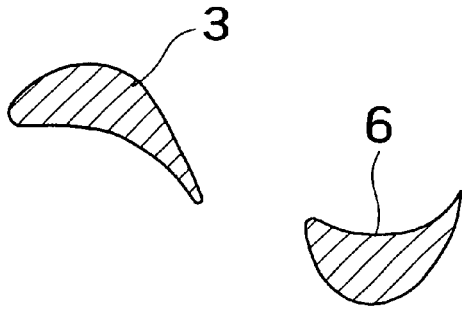
FIG. 9B is a sectional view taken on line A—A in FIG. 9A.
Figure 10:
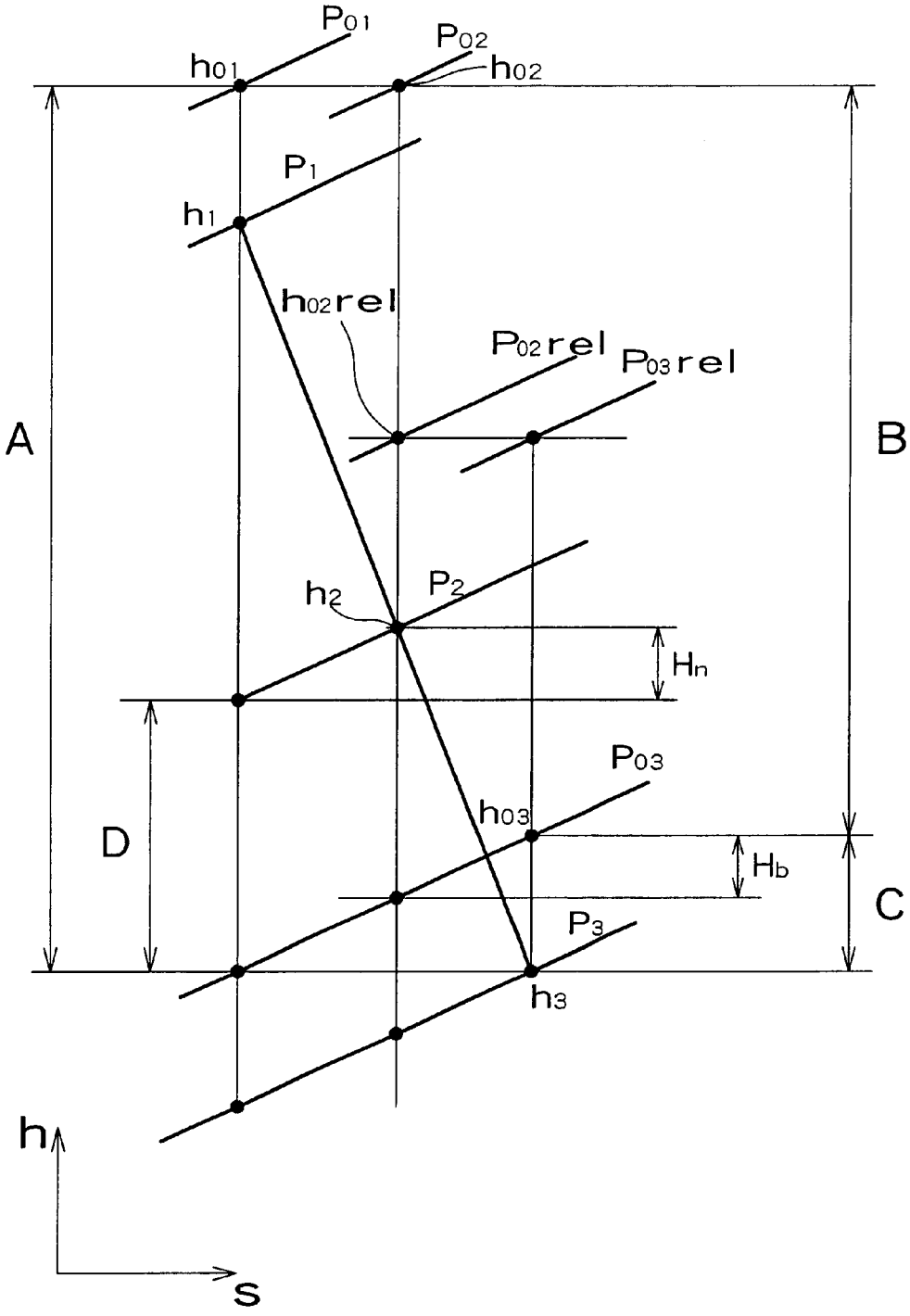
FIG. 10 is an expansion diagram of a working fluid.
Figure 11A:
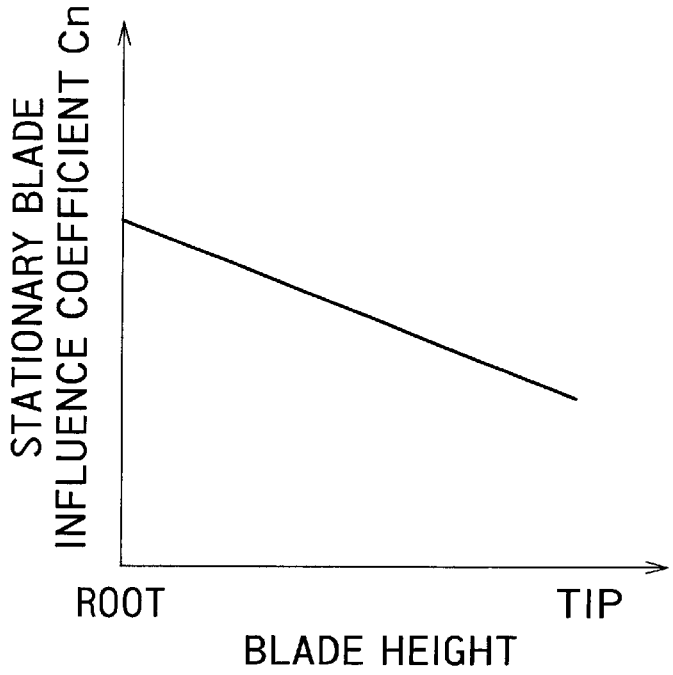
FIGS. 11A and 11B are diagrams showing the dependence of stationary blade influence coefficient and moving blade influence coefficient on height of the blade in the axial-flow turbine stage.
Figure 11B:
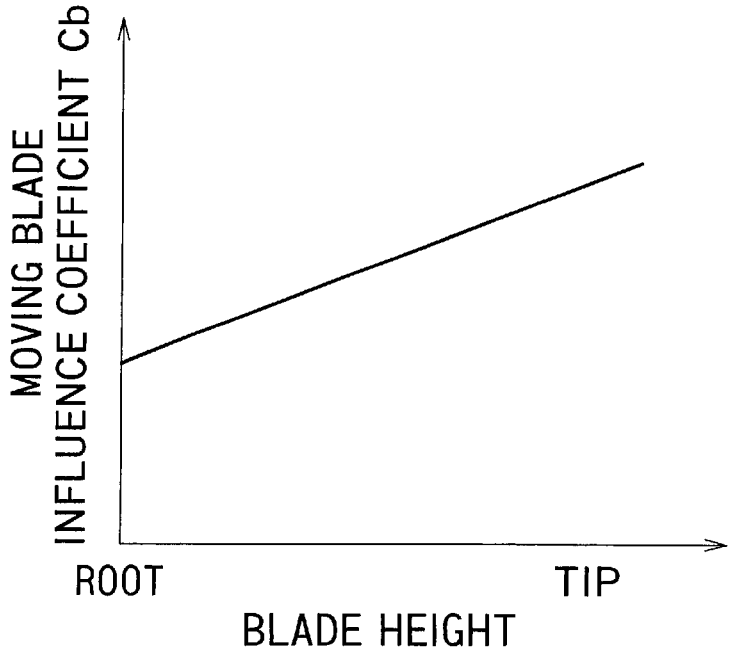
Figure 12:
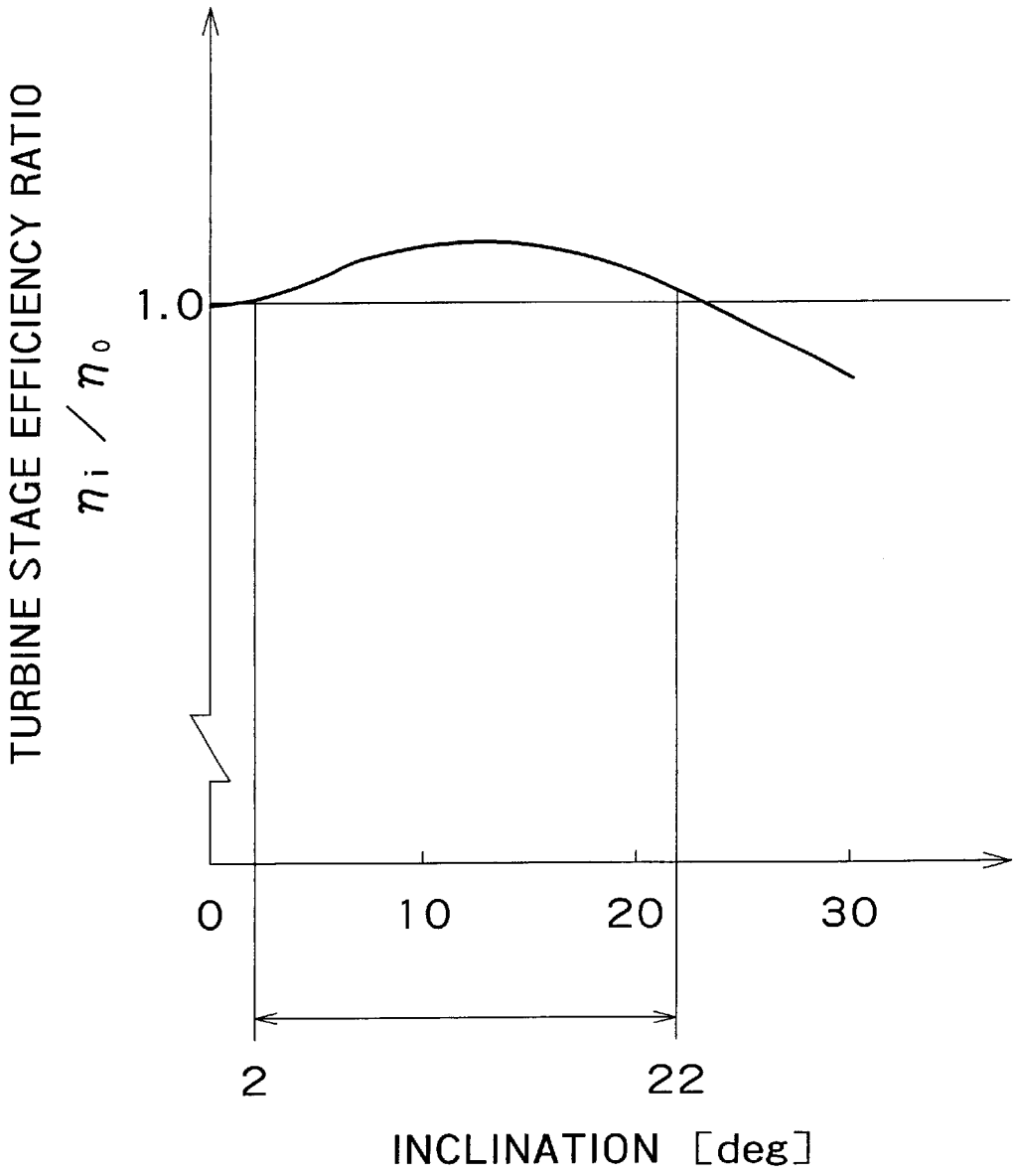
FIG. 12 is a diagram showing the dependence of stage efficiency ratio on the inclination of blades.

FIG. 6 is a graph showing the variation of stage efficiency of the three-dimensional axial-flow turbine. In the graph, the ratio $\theta_{nt}/\theta_{bt}$ is measured on the horizontal axis, and stage efficiency ratio $\eta_{1t}/\eta_{0t}$, where $\eta_{0t}$ is stage efficiency when $\theta_{nt}=\theta_{bt}$, and $\eta_{1t}$ is stage efficiency when the ratio $\theta_{nt}/\theta_{bt}$ is changed, is measured on the vertical axis. As obvious from FIG. 6, stage efficiency $\eta_{1t}$ is higher than stage efficiency $\eta_{0t}$ in a range expressed by $0.3<\theta_{nt}/\theta_{bt}<1.0$. This is because, the pressure difference between the inlet and the outlet of the moving blade 6 when $\theta_{bt}$ is excessively greater than $\theta_{nt}$ is greater than that when $\theta_{nt}=\theta_{bt}$, leakage loss resulting from the leakage of the working fluid through the gap between the fins and the shroud connected to the tips of the moving blades 6 cannot be compensated by the reduction of secondary flow loss by the effect of the three-dimensional shape of the moving blades. In addition, the secondary flow loss reducing effect of the three-dimensional moving blade 6 is reduced when the moving blade root inclination $\theta_{br}$ is excessively small.

Therefore, it is preferable that $0.3<\theta_{nt}/\theta_{bt}<1.0$.

The effect of the three-dimensional stationary blades 3 and the three-dimensional moving blades 6 on the improvement of the turbine stage will be further improved when $$1<\theta_{nr}/\theta_{br}<3 \text{ and } 0.3<\theta_{nt}/\theta_{bt}<1.0$$

What is claimed is:

1. An axial-flow turbine stage comprising:

a plurality of moving blades fixedly mounted on a rotor shaft in a circumferential arrangement about an axis of the rotor shaft; and a plurality of stationary blades disposed axially opposite to the moving blades in a circumferential arrangement about the axis of the rotor shaft;

wherein each of the plurality of stationary blades has a trailing edge convex toward a face side with respect to a radial line radially extending from the axis of the rotor shaft, a blade center-of-gravity line of each of the plurality of moving blades is convex toward the face side with respect to a radial line radially extending from the axis of the rotor shaft, and shapes of the stationary blades and the moving blades meet conditions expressed by:

$$1<\theta_{nr}/\theta_{nt}$$

$$1<\theta_{bt}/\theta_{br}$$

where, as viewed from a direction of the axis of the rotor shaft:

$\theta_{nt}$ is an angle between a tangent to a trailing edge of the stationary blade at a tip of the stationary blade and a radial line passing the tip of the stationary blade and radially extending from the axis of the rotor shaft;

$\theta_{nr}$ is an angle between a tangent to the trailing edge of the stationary blade at a root of the stationary blade and a radial line passing the root of the stationary blade and radially extending from the axis of the rotor shaft;

$\theta_{bt}$ is an angle between a tangent to the blade center-of-gravity line of the moving blade at a tip of the moving blade and a radial line passing the tip of the moving blade and radially extending from the axis of the rotor shaft; and $\theta_{br}$ is an angle between a tangent to the blade center-of-gravity line of the moving blade at the root of the moving blade and a radial line passing the root of the moving blade and radially extending from the axis of the rotor shaft.

2. An axial-flow turbine stage comprising:

a plurality of moving blades fixedly mounted on a rotor shaft in a circumferential arrangement about an axis of the rotor shaft; and a plurality of stationary blades disposed axially opposite to the moving blades in a circumferential arrangement about the axis of the rotor shaft;

wherein each of the plurality of stationary blades has a trailing edge convex toward a face side with respect to a radial line radially extending from the axis of the rotor shaft, a blade center-of-gravity line of each of the plurality of moving blades is convex toward the face side with respect to a radial line radially extending from the axis of the rotor shaft, and shapes of the stationary blades and the moving blades meet conditions expressed by:

$$1<\theta_{nr}/\theta_{br}<3$$

where, as viewed from a direction of the axis of the rotor shaft:

$\theta_{nt}$ is an angle between a tangent to a trailing edge of the stationary blade at a tip of the stationary blade and a radial line passing the tip of the stationary blade and radially extending from the axis of the rotor shaft;

$\theta_{nr}$ is an angle between a tangent to the trailing edge of the stationary blade at a root of the stationary blade and a radial line passing the root of the stationary blade and radially extending from the axis of the rotor shaft;

$\theta_{bt}$ is an angle between a tangent to the blade center-of-gravity line of the moving blade at a tip of the moving blade and a radial line passing the tip of the moving blade and radially extending from the axis of the rotor shaft; and $\theta_{br}$ is an angle between a tangent to the blade center-of-gravity line of the moving blade at the root of the moving blade and a radial line passing the root of the moving blade and radially extending from the axis of the rotor shaft.

3. An axial-flow turbine stage comprising:

a plurality of moving blades fixedly mounted on a rotor shaft in a circumferential arrangement about an axis of the rotor shaft; and a plurality of stationary blades disposed axially opposite to the moving blades in a circumferential arrangement about the axis of the rotor shaft;

wherein each of the plurality of stationary blades has a trailing edge convex toward a face side with respect to a radial line radially extending from the axis of the rotor shaft, a blade center-of-gravity line of each of the plurality of moving blades is convex toward the face side with respect to a radial line radially extending from the axis of the rotor shaft, and shapes of the stationary blades and the moving blades meet conditions expressed by:

$$0.3<\theta_{nt}/\theta_{bt}<1$$

where, as viewed from a direction of the axis of the rotor shaft:

$\theta_{nt}$ is an angle between a tangent to a trailing edge of the stationary blade at a tip of the stationary blade and a radial line passing the tip of the stationary blade and radially extending from the axis of the rotor shaft;

$\theta_{nr}$ is an angle between a tangent to the trailing edge of the stationary blade at a root of the stationary blade and a radial line passing the root of the stationary blade and radially extending from the axis of the rotor shaft;

$\theta_{bt}$ is an angle between a tangent to the blade center-of-gravity line of the moving blade at a tip of the moving blade and a radial line passing the tip of the moving blade and radially extending from the axis of the rotor shaft; and $\theta_{br}$ is an angle between a tangent to the blade center-of-gravity line of the moving blade at the root of the moving blade and a radial line passing the root of the moving blade and radially extending from the axis of the rotor shaft.

4. An axial-flow turbine stage comprising:

a plurality of moving blades fixedly mounted on a rotor shaft in a circumferential arrangement about an axis of the rotor shaft; and a plurality of stationary blades disposed axially opposite to the moving blades in a circumferential arrangement about the axis of the rotor shaft;

wherein each of the plurality of stationary blades has a trailing edge convex toward a face side with respect to a radial line radially extending from the axis of the rotor shaft, a blade center-of-gravity line of each of the plurality of moving blades is convex toward the face side with respect to a radial line radially extending from the axis of the rotor shaft, and shapes of the stationary blades and the moving blades meet conditions expressed by:

$$1<\theta_{nr}/\theta_{br}<3$$

$$0.3<\theta_{nt}/\theta_{bt}<1$$

where, as viewed from a direction of the axis of the rotor shaft:

$\theta_{nt}$ is an angle between a tangent to a trailing edge of the stationary blade at a tip of the stationary blade and a radial line passing the tip of the stationary blade and radially extending from the axis of the rotor shaft;

$\theta_{nr}$ is an angle between a tangent to the trailing edge of the stationary blade at a root of the stationary blade and a radial line passing the root of the stationary blade and radially extending from the axis of the rotor shaft;

$\theta_{bt}$ is an angle between a tangent to the blade center-of-gravity line of the moving blade at a tip of the moving blade and a radial line passing the tip of the moving blade and radially extending from the axis of the rotor shaft; and $\theta_{br}$ is an angle between a tangent to the blade center-of-gravity line of the moving blade at the root of the moving blade and a radial line passing the root of the moving blade and radially extending from the axis of the rotor shaft.

5. An axial-flow turbine comprising a plurality of turbine stages, wherein at least one of the plurality of turbine stages is the axial-flow turbine stage according to any one of claims 1 to 4.

* * * * *